US007150232B1

(12) United States Patent
Rastegar et al.

(10) Patent No.: US 7,150,232 B1
(45) **Date of Patent: *Dec. 19, 2006**

(54) METHODS AND APPARATUS FOR INCREASING AERODYNAMIC PERFORMANCE OF PROJECTILES

(75) Inventors: Jahangir S. Rastegar, Stony Brook, NY (US); Richard B. Pelz, Princeton, NJ (US)

(73) Assignee: Omnitek Partners LLC, Bayshore, NY (US)

( * ) Notice: Subject to any disclaimer, the term of this patent is extended or adjusted under 35 U.S.C. 154(b) by 1 day.

This patent is subject to a terminal disclaimer.

(21) Appl. No.: 11/178,789

(22) Filed: Jul. 11, 2005

Related U.S. Application Data

(60) Continuation of application No. 10/833,475, filed on Apr. 26, 2004, now Pat. No. 6,935,242, which is a division of application No. 10/156,701, filed on May 28, 2002, now Pat. No. 6,727,485.

(60) Provisional application No. 60/293,622, filed on May 25, 2001.

(51) Int. Cl.
*F42B 10/38* (2006.01)

(52) U.S. Cl. ..... 102/501; 244/3.1

(58) Field of Classification Search ..... 102/350, 102/440, 501, 473, 490, 374, 381; 244/3.1, 244/3.21

See application file for complete search history.

(56) References Cited

U.S. PATENT DOCUMENTS

| | | | | |
|---|---|---|---|---|
| 1,879,579 | A | | 9/1932 | Stolfa et al. |
| 2,816,721 | A | | 12/1957 | Taylor |
| 3,070,955 | A | | 1/1963 | Gosta et al. |
| 3,122,884 | A | | 3/1964 | Grover et al. |
| 3,698,321 | A | | 10/1972 | Wall |
| 4,197,800 | A | | 4/1980 | Greever et al. |
| 4,213,267 | A | * | 7/1980 | Curtis ..... 446/221 |
| 4,754,704 | A | | 7/1988 | Lubbers |
| 4,807,532 | A | | 2/1989 | Andersson et al. |
| 5,056,436 | A | | 10/1991 | Greene |
| 5,108,339 | A | * | 4/1992 | Kieves ..... 446/221 |
| 5,533,285 | A | * | 7/1996 | Skistimas et al. ..... 40/584 |
| 5,675,922 | A | * | 10/1997 | Skistimas ..... 40/584 |
| 6,158,349 | A | | 12/2000 | Altenau et al. |
| 6,213,023 | B1 | | 4/2001 | Gunners |
| 6,297,486 | B1 | | 10/2001 | Rom et al. |

* cited by examiner

*Primary Examiner*—Timothy D. Collins

(57) ABSTRACT

A method for enhancing an aerodynamic performance of an unmanned projectile. The method including at least one of the following: (a) morphing a cross-sectional shape of the projectile after launch thereof; (b) morphing a longitudinal shape of the projectile after launch thereof; (c) bleeding a fluid at a base of the projectile during flight thereof: (d) varying a base cone angle of the projectile as a function of speed thereof; (e) deploying at least one wing from a body of the projectile after launch thereof; and (f) deploying a fin from the body of the projectile after launch thereof.

8 Claims, 8 Drawing Sheets

FIG. 7c
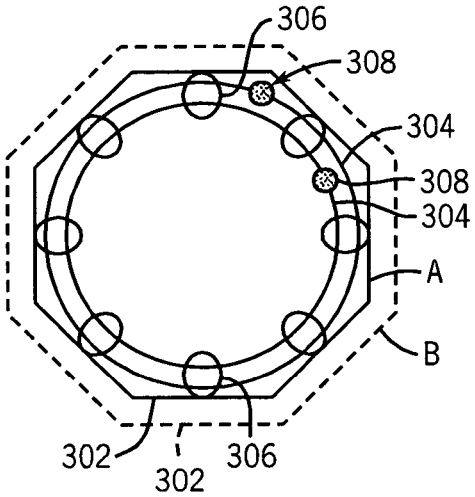
FIG. 7d
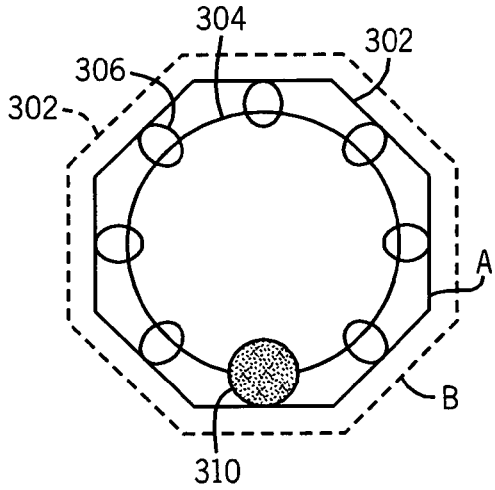
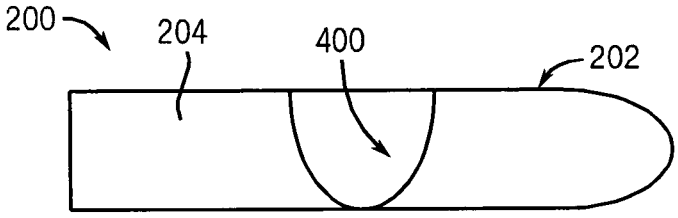
FIG. 8a

METHODS AND APPARATUS FOR INCREASING AERODYNAMIC PERFORMANCE OF PROJECTILES

CROSS-REFERENCE TO RELATED APPLICATIONS

This application is a continuation of U.S. application Ser. No. 10/833/475, filed on Apr. 26, 2004 now U.S. Pat. No. 6,935,242, which is a divisional application of U.S. application Ser. No. 10/156,701 filed on May 28, 2002 now U.S. Pat. No. 6,727,485, which claims the benefit of earlier filed provisional patent application 60/293,622 filed on May 25, 2001, entitled "Smart Munitions," the contents of each of which are incorporated herein by their reference.

BACKGROUND OF THE INVENTION

1. Field of the Invention

The present invention relates generally to projectiles (which includes munitions, and more particularly, to methods and devices for increasing the performance of projectiles.

2. Prior Art

There are proven aerodynamic ideas for improving performance for both supersonic and subsonic aircraft. These ideas increase the altitude that the aircraft can operate as well as their range.

Present munitions and other projectiles have not utilized these ideas due to constraints of launch and static shape.

SUMMARY OF THE INVENTION

Therefore it is an object of the present invention to provide a methods and apparatus for increasing the performance of projectiles.

Thus a primary objective of the methods and apparatus of the present invention is to implement a number of performance enhancements in terms of increased range (lower drag and higher lift) for projectiles, particularly, for the next generation of smart and guided munitions. These enhancements are preferably passive, i.e., require no closed-loop control action and preferably result in no penalty in cargo volume.

Accordingly, an unmanned projectile is provided. The projectile comprising at least one of the following enhancements to increase its aerodynamic performance: (a) means for morphing a cross-sectional shape of the projectile after launch thereof; (b) means for morphing a longitudinal shape of the projectile after launch thereof; (c) means for bleeding a fluid at a base of the projectile during flight thereof: (d) means for varying a base cone angle of the projectile as a function of speed thereof; (e) means for deploying at least one wing from a body of the projectile after launch thereof; and (f) means for deploying a fin from the body of the projectile after launch thereof.

The means for morphing the cross-sectional shape of the projectile preferably comprises a retention means for retaining a skin of the projectile prior to launch and release means for releasing the retention after launch. The retention means preferably comprises a plurality of separating elements disposed between and inner and outer skin of the projectile and connected thereto. The release means preferably comprises a wire member having a charge thereon.

Alternatively, the retention means comprises a plurality of structural elements having a fluid disposed in a cavity therein. In which case, the release means preferably comprises a means for releasing pressure in the cavity to release at least a portion of the fluid therefrom.

In another alternative, the retention means comprises a sabo disposed around an outer periphery of the projectile. In which case, the release means preferably comprises means for discarding the sabo upon launch.

Preferably, the means for morphing a longitudinal shape of the projectile comprises a means for morphing a plurality of cross-sections of the projectile along a longitudinal length of the projectile to achieve a desired longitudinal shape.

Preferably, the means for bleeding a fluid at a base of the projectile comprises means for directing a fluid from a cavity between inner and outer skins of the projectile to a base of the projectile.

Where the projectile has a base, the base having a plurality of panels that are movable relative to a body of the projectile to form an angle with the body, the means for varying a base cone angle of the projectile preferably comprises means for varying the angle of the plurality of panels relative to the body. The means for varying the angle of the plurality of panels preferably comprises at least one circumferential member attached to each of the panels to restrain the panels at a predetermined angle with the body and a means for releasing the circumferential member. Alternatively, the means for varying the angle of the plurality of panels comprises at least one circumferential member attached to each of the panels to restrain the panels at a predetermined angle with the body and a means for varying the length of the circumferential member.

Preferably, the projectile comprises an outer skin having the at least one deployable wing restrained thereon, wherein the means for deploying the at least one wing from a body of the projectile preferably comprises means for releasing the retention of the at least one wing to deploy the same. Preferably, the means for releasing the retention comprises a locking strip disposed on the skin and having a portion thereof which interferes with the wing to prevent its deployment and a release means for releasing the strip from interfering with the wing.

The projectile preferably further comprises means for shaping the wing after deployment thereof.

Preferably, the projectile comprises an outer skin having the at least one deployable fin restrained thereon, wherein the means for deploying at least one fin from a body of the projectile preferably comprises means for releasing the retention of the at least one fin to deploy the same. Preferably, the means for releasing the retention comprises a locking strip disposed on the skin and having a portion thereof which interferes with the fin to prevent its deployment and a release means for releasing the strip from interfering with the fin.

The projectile preferably further comprises means for shaping the fin after deployment thereof.

Also provided is a method for enhancing an aerodynamic performance of an unmanned projectile. The method comprising at least one of the following: (a) morphing a cross-sectional shape of the projectile after launch thereof; (b) morphing a longitudinal shape of the projectile after launch thereof; (c) bleeding a fluid at a base of the projectile during flight thereof: (d) varying a base cone angle of the projectile as a function of speed thereof; (e) deploying at least one wing from a body of the projectile after launch thereof; and (f) deploying a fin from the body of the projectile after launch thereof.

Preferably, the morphing of the cross-sectional shape of the projectile comprises retaining a skin of the projectile prior to launch and releasing the retention after launch.

Preferably, the morphing of the longitudinal shape of the projectile comprises morphing a plurality of cross-sections of the projectile along a longitudinal length of the projectile to achieve a desired longitudinal shape.

Preferably, the bleeding of the fluid at a base of the projectile comprises directing a fluid from a cavity between inner and outer skins of the projectile to a base of the projectile.

Where the projectile has a base, the base having a plurality of panels that are movable relative to a body of the projectile to form an angle with the body, the varying of the base cone angle of the projectile preferably comprises varying the angle of the plurality of panels relative to the body.

Where the projectile comprises an outer skin having the at least one deployable wing restrained thereon, the deploying of the at least one wing from a body of the projectile preferably comprises releasing the retention of the at least one wing to deploy the same.

The method preferably further comprises shaping the wing after deployment thereof.

Preferably, the projectile comprises an outer skin having the at least one deployable fin restrained thereon, wherein the deploying of the at least one fin from a body of the projectile comprises releasing the retention of the at least one fin to deploy the same.

Preferably, the method further comprises shaping the fin after deployment thereof.

BRIEF DESCRIPTION OF THE DRAWINGS

These and other features, aspects, and advantages of the apparatus and methods of the present invention will become better understood with regard to the following description, appended claims, and accompanying drawings where:

FIG. 7*c* illustrates a sectional view taken along line 7*c*—7*c* of FIG. 7*b* showing a preferred implementation of a means for varying the base cone angle.

FIG. 7*d* illustrates a sectional view taken along line 7*c*—7*c* of FIG. 7*b* showing an alternative implementation of a means for varying the base cone angle.

FIG. 8*a* illustrates a longitudinal view of a projectile of the present invention having deployable wings, shown before deployment thereof.

DETAILED DESCRIPTION OF THE PREFERRED EMBODIMENT

Although this invention is applicable to numerous and various types of projectiles, it has been found particularly useful in the environment of munitions. Therefore, without limiting the applicability of the invention to munitions, the invention will be described in such environment.

In general, the methods and apparatus of the present invention provides means for morphing the shape of the munitions and components thereof after launch of the munition. As discussed fully below, those skilled in the art will appreciate that the munitions morph after launch, withstand high-g loads, withstand the environmental conditions of the launch, the canards and wings preferably sprout at or near apogee, the cargo preferably stays cylindrical (no deformation), and they require minimal or no external power.

Figure 1:
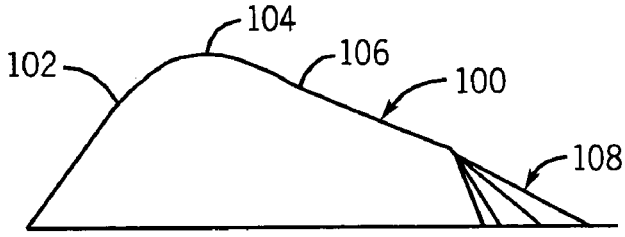
FIG. 1 illustrates a flight path of the munitions of the present invention.

Referring now to FIG. 1, the maneuver methodology will be described with regard to the flight path pattern 100 of the projectile. Following firing, lift increase and drag reduction methods are deployed (e.g., camber and oval section). The fins are deployed, as may be the canards, particularly for subsonic flights. This portion of the flight path is referred to as the ballistic mode 102 of flight. At or near an optimum point before apogee 104, the wings and canards are deployed for the glide portion 106 of the flight path. During the glide 106 or maneuvering portions 108 of the flight path 100, the wings are used for banking turns and the canards for sharper maneuvering turns. The fins may also be equipped with actuators to provide control action for maneuvering.

The following enhancement topics for projectiles, and munitions in particular will be discussed below under separate headings: Boat-tailing and Base Bleed (decreases supersonic drag); Lifting Body (cruciform to monoplanar) and camber (increase lift/drag (L/D), decrease stability margin); Fins (reduce drag by increasing trim efficiency); Wings and/or Canards (increase L/D, camber, dihedral, bank to turn (BTT)).

Lifting Body

Many Studies show an elliptical cross section of a munition increases its L/D and its range. In the case where the cross-section of the munition is elliptical, the fuselage provides lift. The increase in L/D is estimated at a minimum 5–10% increase.

Therefore, the present methods change the cross-sectional shape of the munition after launch and/or add Camber to the fuselage (i.e., skin) of the munition after it has been launched. This results in an increased lift at a fixed angle of attack, and decreases the stability margin of the munition. Preferably, at a fixed inner cylinder and outer circumference, the outer skin is shaped after launch of the munition to maximize the aerodynamic performance of the munition.

Figure 2A:
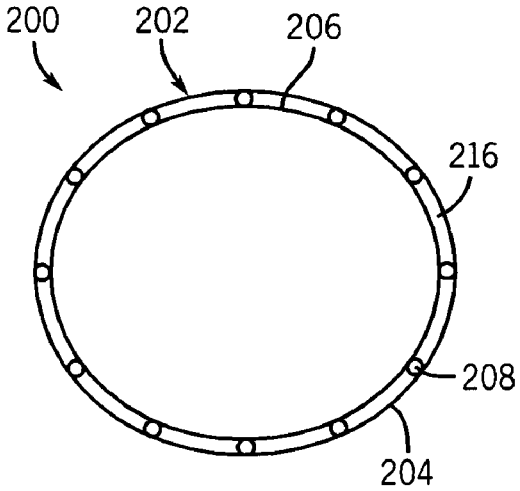
FIGS. 2*a* and 2*b* illustrate sectional views of a munition, FIG. 2*a* showing the munition at launch while FIG. 2*b* showing the munition after launch.
Figure 2B:
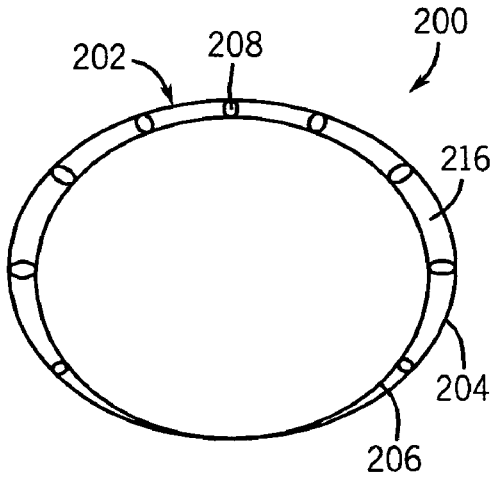

Referring now to FIGS. 2*a* and 2*b*, there is shown a cross-section of a projectile, the projectile being generally referred to by reference numeral 200, FIG. 2*a* showing the projectile at launch while FIG. 2*b* showing the projectile after launch. The skin 202 is preferably constructed (wholly or partly) with two or more layers, referred to herein as an outer layer 204 and an inner layer 206. The inner layer 206 may be a wall or may be a structure or frame that supports the outer layer and the internal components of the projectile. At desired positions in the longitudinal direction, the cross-section of the projectile is varied by varying the height or the force applied by the skin support elements (also called smart separating elements) 208, thereby allowing the preloaded skin to tend to its unloaded (oval or any other appropriate shape).

Figure 3:
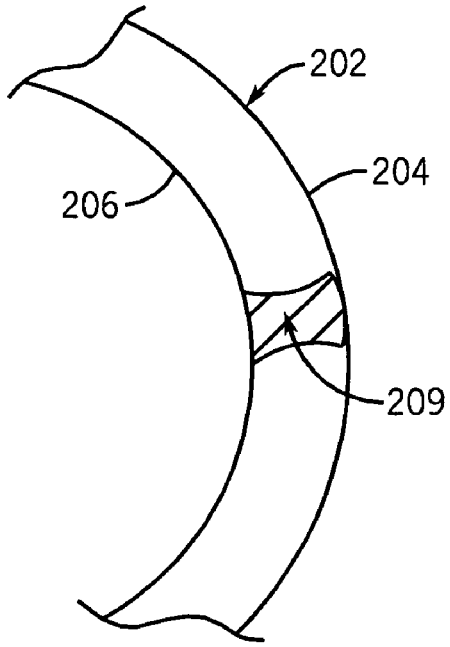
FIG. 3 illustrates a portion of the sectional view of FIG. 2*a*.

The inner and outer skins 206, 204 are separated with one or more of the "Smart Separating Elements" 208 and one or more elements 209 in the form or small column elements, ribs or any other commonly used members for the purpose of holding the inner and outer skins 206, 204 at a predetermined distance apart. The elements 209 must at the same time allow the outer skin 204 to deform during its morphing phase. The elements 209 are preferably in simple planar contact with the outer skin 204 and the contacting surfaces are shaped to allow the aforementioned morphing of the outer skin 204 while serving as a "mandrel" type of element for supporting the morphing outer skin 204 at its desired morphed shape as shown in FIG. 3.

Figure 4:
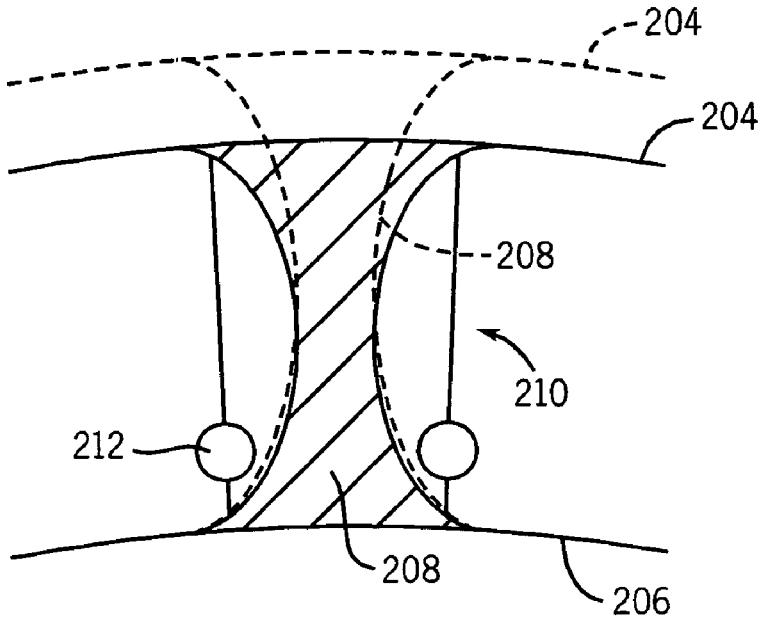
FIG. 4 illustrates a portion of the sectional views of FIGS. 2*a* and 2*b*, FIG. 2*a* being shown as solid lines while FIG. 2*b* being shown as dashed lines.

The Smart Separating Elements 208 are initially formed to keep the outer skin 204 in its cylindrical (or other launch) shape. The morphing of the outer skin 204 occurs once the Smart Separating Elements are allowed to take their prescribed shape, in which case their height is either increased or decreased. In general, their outer skin contact surfaces are not altered or at most minimally altered. The Smart Separating Elements 208 are preferably made out of superelastic or spring type of materials that are preloaded into their pre-morphing shape and are held in that position by either shape memory elements (preferably wires) or wire type of elements 210 that are ruptured by a small charge 212 or current as is shown in FIG. 4.

The skin support elements 208 may also be used to pull on the skin to force it to tend to conform to the desired cross-section. The skin support elements 208 may be simple columns, beams, springs, etc., or any of their combination. The skin support elements 208 may also be constructed with structural elements as disclosed in U.S. Pat. No. 6,054,197 to Rastegar, the contents of which is incorporated herein by its reference. The structural elements 208 are filled with an appropriate type of fluid or soft rubber or polymer type of material. The structural elements 208 are kept in their initial (preloaded) positions by providing an appropriate amount of internal fluid (soft rubber or polymer material) pressure. During the morphing process, the internal pressure is released by a small charge of by activating a shape memory element, preferably the wire member 210. The internal pressure may be released, for example, by opening a release window (not shown).

Figure 5:
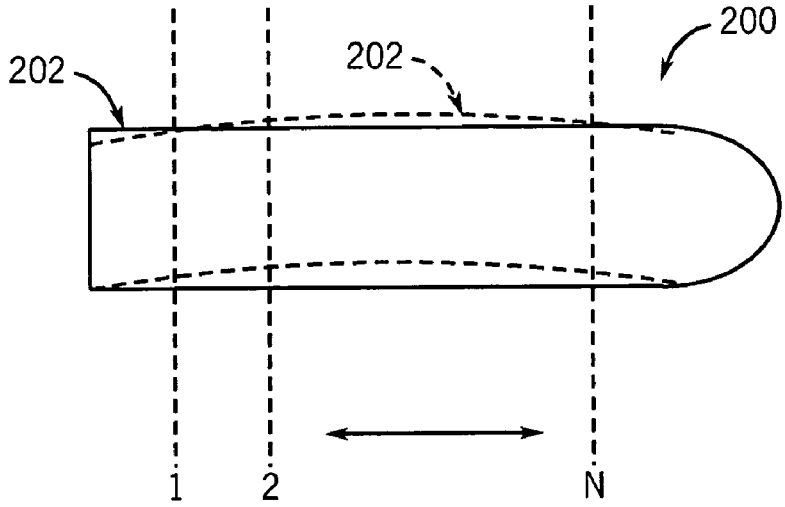
FIG. 5 illustrates a longitudinal view of the projectile of FIGS. 2*a* and 2*b*.
Figure 6:
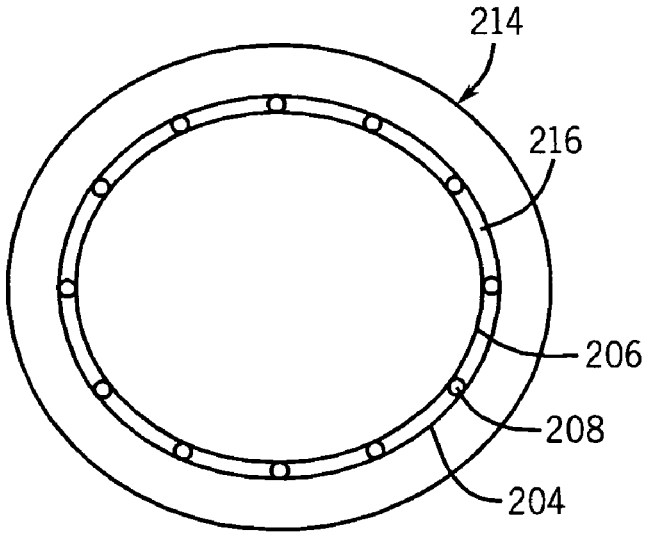
FIG. 6 illustrates an alternative cross-sectional view of the projectile of the present invention having a sabo disposed around the outer skin thereof.

The pressure within the internal cavities of the structural elements 208 may be released or otherwise varied or the internal volume of several structural elements 208 may be interconnected and their internal pressure varied by an external or internal fluid pressure source to achieve the desired variation in the skin cross-section. The structural elements 208 or the space between the skin layers may also be filled with appropriate fluid to be released to achieve a desired base bleed (discussed below). By releasing some of the structural elements, or releasing some to a greater degree than others, the cross-sectional shape of the projectile can be varied, for example from a circular cross-sectional shape at paunch as shown in FIG. 2*a* to an elliptical cross-sectional shape as is shown in FIG. 2*b*. Those skilled in the art will appreciate that by varying a plurality of cross-sections of the skin 202 in the longitudinal direction differently along the length of the projectile, a desired longitudinal shape (e.g., camber shape) can be obtained, such as that illustrated in FIG. 5. In order to achieve a 3D shape (to form the projectile 200 into the desired lifting body shape), the aforementioned morphing of the outer skin 200 is made to achieve different final morphing shapes at different cross-sections 1, 2, . . . , N along the length of the projectile, FIG. 5. In FIG. 5, the projectile's shape at launch is shown in solid lines, while the morphed shape is shown in dashed lines.

In another implementation of the present invention, all the elements 208, 209 that separate the inner and outer skin 206, 204, are relatively rigid, i.e., are not intended to change their height and/or shape. The cylindrical shape of the outer shell 204 is ensured by a sabo 214 within which it is packaged for firing through a cannon. The use of sabos 214 is well known in the art to prevent the inner lining of the cannon from being damaged by the firing of the projectile. The sabo 214 is generally plastic and falls off the projectile after it is launched. The morphing occurs as the sabo 214 is discarded. Thus, the sabo 214 retains the cylindrical (or other pre-launch) shape of the projectile 200 before launch. After launch, the sabo 214 is discarded (falls off) thereby releasing the restraints on the cross-sectional shape of the projectile and allowing it to take another post-launch shape, such as the ellipse of FIG. 2*b*.

Base Bleed:

Published literature has shown that base bleed, i.e., bleeding gas behind a flying objects, can reduce drag by as much as 20 percent. The reason is that as a projectile travels in a fluid such as air, a zone of relatively low pressure is generated behind the projectile, right behind its trailing surfaces. Base bleed provides a mass flow at the base of the projectile, thereby allowing the base pressure to be recovered and also provides a more streamlined wake. As the result, the corresponding drag is greatly reduced, in many cases as much as 20 percent of the overall drag levels. In a preferred embodiment of the present invention, part or the entire space 216 between the outer and inner skins 204, 206 of the projectile 200 is filled with fluids (gas or a mixture of the two) to serve as the base bleed exhaust fluid. The exhaust fluid provides for base bleed as the fuselage shape begins to change. In the preferred embodiment of the present invention, the base bleed fluid is a fuel such as a very heavy oil to provide the maximum amount of exhaust gas as it is burned through exhaust "nozzle" types of openings. The burning process may be initiated electrically by setting of small charges or by igniting a secondary pyrotechnic material, which at the same time cause the fluid exit holes to open.

In addition, the fluid filled smart structural elements 208 may also contain such type of fuels. Upon the release of the above fluids, they may be exhausted from the back of the projectile 200 during flight to act as a base bleed to reduce drag. When the fluid is in the form of a fuel, the fuel may be burned and exhausted from the base to act as an even more effective base bleed. The fuel may also be utilized to provide thrust to increase range or exhausted through thrusters to provide a means of guiding the projectile 200 according to a command signal.

In another embodiment of the present invention, the inner skin 206 is replaced by a simple, preferably truss type of structure to provide mounting surfaces for the aforementioned Smart Separating Elements 208. In which case, the separating elements are not desired to contain fluids such as fuels.

In general, when the outer skin 204 deformation is significant and beyond the limits of for example stainless steel or spring steel plates with the required thickness, then superelastic metals are preferred for skin construction. In other embodiments, aforementioned steel, aluminum, titanium or even composite materials may be used. When using such materials, when the amount of deformation is significant, living joints are added, mostly in the longitudinal directions, in order to allow the desired levels of outer skin deformation to be achieved without the possibility of failure.

Boat-Tailing:

Boat-tailing consists of the reduction of the aft cross-sectional area of a flying object in order to reduce drag. Boat-tailing is most effective and critical for supersonic flights. For each speed of a projectile and the flying altitude, there is an optimal boat-tailing angle. For example, if the boat-tailing is two extreme, i.e., the aft cross-sectional area is reduced too rapidly along the length of the flying object, then aft shock becomes too strong, boundary layer separation occurs and drag is considerably increased. If the rate of reduction in the aft cross-section is too slow, then the amount of reduction in the drag is minimal.

The optimal boat-tailing cone angle ($\alpha$) is a function of Mach number. The boat-tailing angle is the largest at the highest projectile speeds and is gradually decreased as the projectile speed approaches the subsonic speeds. In the preferred embodiment of the present invention, the boat-angle is varied as a function of the speed according to an appropriate schedule in order to keep the cone angle at near its optimal position to achieve near minimal drag. In the preferred embodiment of the present invention, the boat-tailing angle is varied to a number of discrete angles rather than being varied continuously as the speed of the projectile is reduced. With such a design, a very simple and inexpensive boat-tailing mechanism is achieved that would also not occupy a considerable amount of space. It has been shown that base drag accounts for up to 50% of total drag on a projectile during supersonic flight. With base bleed and boat-tailing, drag in supersonic flight has been shown to be significantly reduced.

Figure 7A:
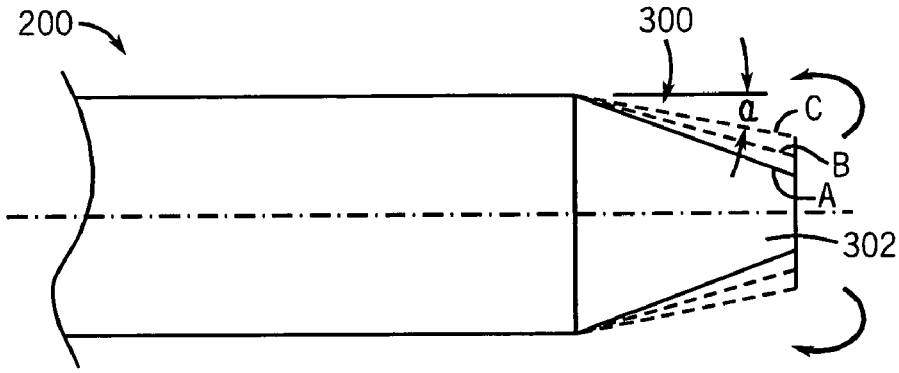
FIG. 7*a* illustrates a longitudinal view of the projectile of the present invention having a base cone with a varying angle.
Figure 7B:
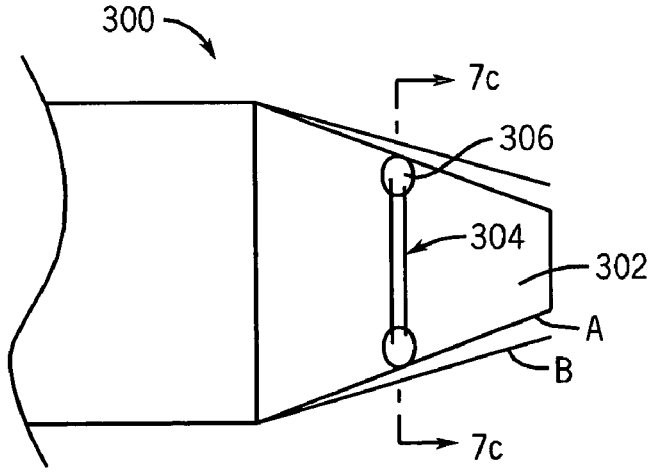
FIG. 7*b* illustrates the base cone of FIG. 7*a* having a means for varying the angle of the base cone.
Figure 8B:
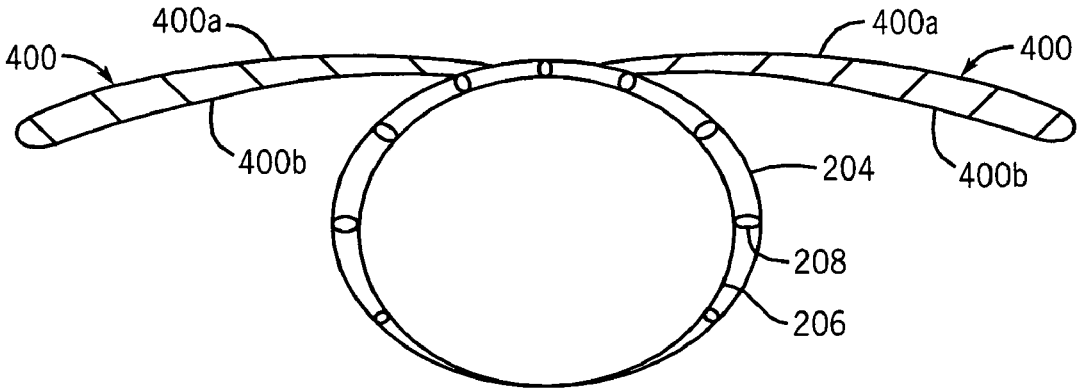
FIG. 8*b* illustrates a sectional view of the projectile of FIG. 8*a* showing the deployable wings in a deployed position.

Referring now to FIGS. 7*a*, 7*b*, and 7*c*, there is illustrated a base or aft cone 300 of projectile 200. The base cone 300 is preferably constructed with longitudinal panels 302, shown in their original position in solid lines. The panels 302 can have a corrugated shape or the like. The panels 302 are preloaded to a smaller back diameter shape designated "A" in FIG. 7*a*, i.e., the largest cone angle and held in place by a number of circumferential elements 304 such as shape memory alloy wires or regular spring wires or the like. Each circumferential element 304 is sized to arrest the cone angle at one of its (decreasing) angles (designated by "B" and "C" in FIG. 7*a* and is itself connected to each panel by wire loops 306. Preferably, the circumferential elements 304 have differing diameters and are released sequentially. In this way, the cone angle begins to increase, i.e., open in the direction from "A" to "B" as is shown in FIGS. 7*a*, 7*b*, and 7*c* (with position A being shown in solid lines and position B being shown in dashed lines). The circumferential elements 304 (for example wire elements) can be released by passing current through them when they are constructed with shape memory alloys or by setting off a small charge 308 to cut the wire. When the smaller of the circumferential wires is released, the panels 302 are then retained by the next largest circumferential wire 304 and the wire loops 306. The cone angle can therefore be varied such that it is nearly optimal for different speeds of travel.

Referring now to FIG. 7*d*, in another embodiment of this invention, an electrical actuator (linear or rotary motors) 310 is used to provide the means of varying the cone angle, for example by releasing (retracting) a cable (wire) 304 similar to the aforementioned circumferential elements to vary the cone angle. The latter embodiment has the advantage of providing a continuous means of varying the boat-tailing angle, both in the direction decreasing it and in the direction decreasing it.

By releasing the elements sequentially, the cone begins to open in the indicated direction. The cone angle can be varied such that it is nearly optimal for different speeds of travel. Another option is to preload the support elements and release them (their pressure or preloading force) to vary the cone angle.

Figure 9:
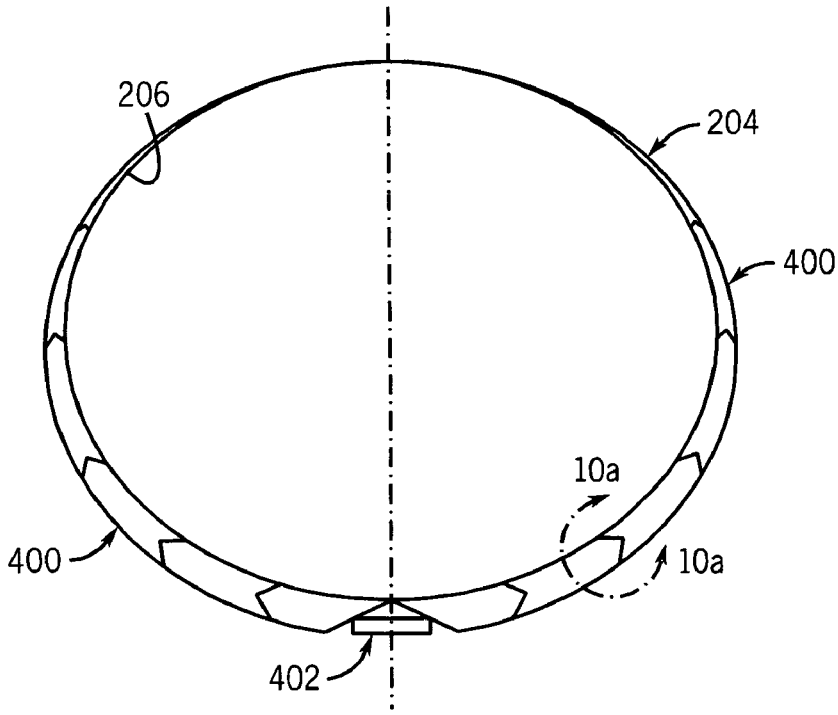
FIG. 9 illustrates a sectional view of the projectile of FIG. 8*a* showing the deployable wings before deployment thereof.
Figure 10A:
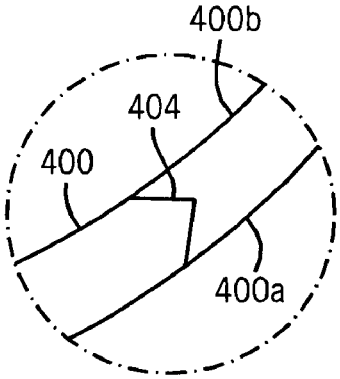
FIG. 10*a* illustrates a partial section of a deployable wing of FIG. 9 before deployment thereof.
Figure 10B:
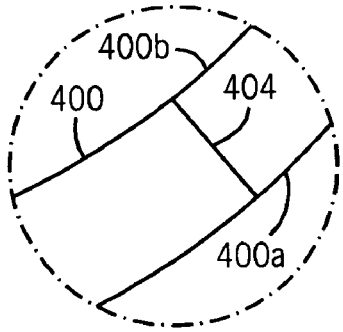
FIG. 10*b* illustrates the partial section of the deployable wing of FIG. 10*a* after deployment thereof.

Wings:

In the preferred embodiment of the present invention, wings 400 are formed from a portion of the outer skin 204 of the projectile 200. The wings 400 are preferably preloaded in a cylindrical shape as shown in FIG. 9 and retained therein by a retention means 402. The wings 400 are preferably constructed with superelastic materials to allow for the high levels of deformation needed to achieve the desired shape from a preloaded cylindrical shape. The wings 400 are further preferably constructed with an upper and lower skin 400*a*, 400*b*. The upper and lower skins 400*a*, 400*b* have internal stiffening ribs 404 are initially preloaded into their cylindrical shape as shown in FIG. 9 and held in place by the retention means 402, such as one or more wires or flat strips 402. The holding wires (flat strips) 402 may be made out of shape memory alloys in which case the wings 400 are deployed by breaking them, preferably by passing an appropriate amount of current through them. In another embodiment, the retention means 402 also includes a small charge (not shown) used to break the holding wires or flat strips by detonating them. In either case, once the wings 400 are released, the preloading forces in the upper and lower wing skins 400*a*, 400*b* and the preloaded stiffening ribs 404 provide the required forces to deploy the wings 400 and hold them firmly in place. The preloaded stiffening ribs 404 are preferably spring material and deploy upon deployment of the wings as shown in FIGS. 10*a* and 10*b* (10*a* showing the stiffening ribs in a restrained position, while FIG. 10*b* showing the stiffening ribs in a deployed position).

Fins and Canards:

Primary Function of the fins and canards (collectively referred to in the appended claims as "fins") is to create stabilizing moment, drag. They can be controlled to orient and roll the projectile. With Lifting body, they may be needed to trim at max L/D. In addition, camber and dihedral can be added to increase effectiveness.

Figure 11A:
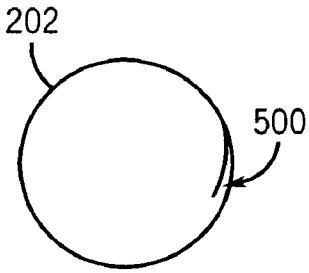
FIG. 11*a* shown a cross-sectional shape of a projectile having a fin or canard thereon before deployment thereof.
Figure 11B:
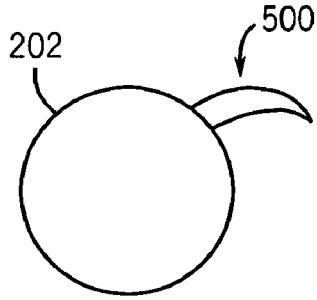
FIG. 11*b* illustrates the cross-sectional shape of FIG. 11*a* in which the fin or canard is deployed.
Figure 11C:
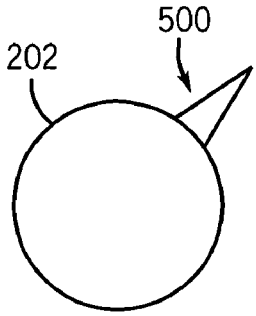
FIG. 11*c* illustrates the cross-sectional shape of FIG. 11*b* in which the deployed fin or canard is further morphed by adding camber in the radial direction thereto.
Figure 12A:
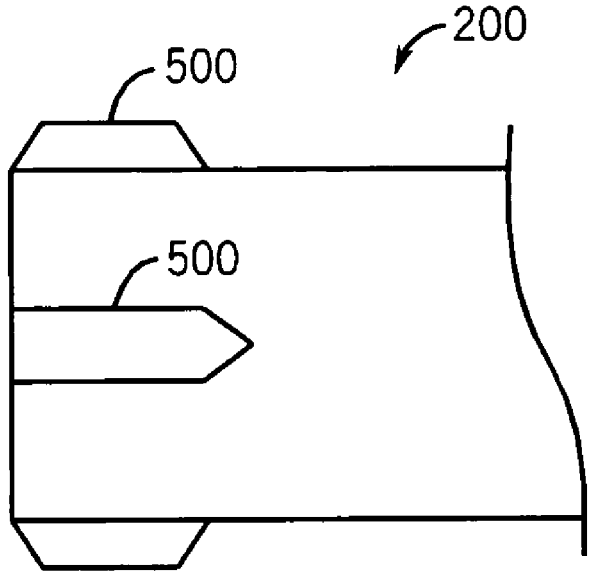
FIGS. 12*a* and 12*b* illustrate a fin or canard deployed and morphed by adding camber in a longitudinal direction, respectively.
Figure 12B:
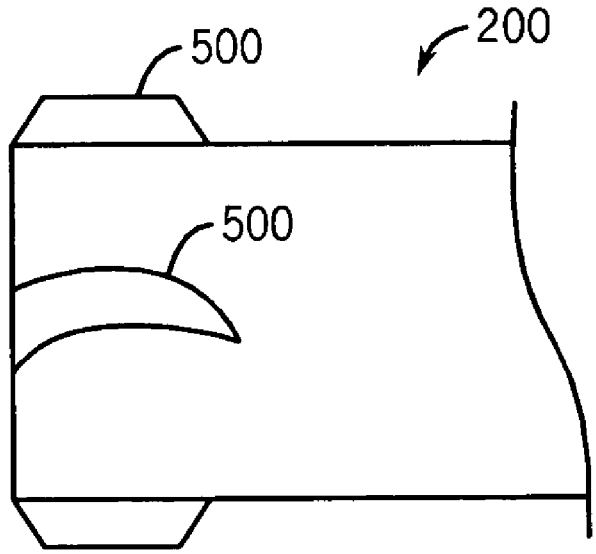

Referring now to FIGS. 11*a*, 11*b*, and 11*c*, the fins and canards 500 are preferably retracted on the skin 202 of the projectile 200 and extended at apogee for glide. The fins and canards are constructed with one or more skins which are conformed to the desired shape at the desired stages of the flight using the methods described for the projectile skin and wings. The transformation may be made in steps or continuously. The fins and canards may also be conformed to their desired shape using the methods and means described for the wings. FIG. 11*c* shows the canard being morphed after deployment by adding camber in a radial direction. FIG. 12*a* illustrates a longitudinal view of the deployed fin or canard 500 and FIG. 12*b* illustrates the fin or canard 500 being morphed by adding camber in the longitudinal direction.

The transformation may be made in steps or continuously using mechanisms as described above for boat-tailing. The preferred embodiment of the present invention provides for an undeformed shape as shown in FIG. 11*b* and a deformed shaped change (morphing) as shown in FIG. 11*c*. In general, the canards 500 are used for guidance and control action. Thereby an electric motor (not shown) may be used to rotate the deployed canards (about an axis which is essentially perpendicular to the longitudinal axis of the projectile). Similar means of rotation may also be provided for the fins.

In summary, the above described enhancements are made to munitions, separately or in any combination to significantly increase L/D and decrease stability margin; to decrease supersonic drag; to maximize supersonic drag reduction significantly range and BTT for added maneuverability during the glide mode; and to reduce drag by increasing trim efficiency.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An unmanned munition comprising:

a skin having a cavity associated thereon, the cavity having a fluid disposed therein; and means for bleeding the fluid from the cavity at a base of the munition during flight;

wherein the bleeding of the fluid from the cavity changes the shape of the skin.

2. The munition of claim 1, wherein the means for bleeding the fluid at the base of the munition comprises means for directing the fluid from the cavity between inner and outer skins of the munition to the base of the munition.

3. The munition of claim 1, wherein the fluid is an oil.

4. The munition of claim 1, wherein the fluid is a fuel.

5. A method for enhancing an aerodynamic performance of an unmanned munition, the method comprising:

disposing a fluid within a cavity associated with a skin of the munition;

bleeding the fluid from the cavity at a base of the munition during flight thereof; and changing a shape of the skin due to the bleeding of the fluid from the cavity.

6. The method of claim 5, wherein the bleeding of the fluid at the base of the munition comprises directing the fluid from the cavity between inner and outer skins of the munition to the base of the munition.

7. The method of claim 5, wherein the fluid is a fuel, the method further comprising burning the fuel at the base to provide thrust.

8. An unmanned projectile comprising:

a skin having a cavity associated thereon, the cavity having an oil disposed therein; and means for bleeding the oil from the cavity at a base of the projectile during flight;

wherein the bleeding of the oil from the cavity changes the shape of the skin.

* * * * *